7/9/85 XR 4,528,476

United States Patent [19]

Alig

[11] Patent Number: 4,528,476

[45] Date of Patent: Jul. 9, 1985

[54] CATHODE-RAY TUBE HAVING ELECTRON GUN WITH THREE FOCUS LENSES

[75] Inventor: Roger T. Alig, Princeton Junction, N.J.

[73] Assignee: RCA Corporation, Princeton, N.J.

[21] Appl. No.: 545,049

[22] Filed: Oct. 24, 1983

[51] Int. Cl.[3] ..... H01J 29/50

[52] U.S. Cl. ..... 313/412; 313/409; 313/414; 313/449; 313/458; 313/460

[58] Field of Search ..... 313/409, 412, 414, 449, 313/458, 460

[56] References Cited

U.S. PATENT DOCUMENTS

| | | | |
|---|---|---|---|
| 2,975,315 | 3/1961 | Szegho | 313/82 |
| 3,448,316 | 6/1969 | Yoshida et al. | 313/69 |
| 3,462,638 | 8/1969 | Tetsuo et al. | 315/13 |
| 3,500,114 | 3/1970 | Sawai | 315/13 |
| 3,619,687 | 11/1971 | Miyaoka et al. | 313/78 |
| 3,852,637 | 12/1974 | Yamazaki et al. | 315/16 |
| 3,873,879 | 3/1975 | Hughes | 315/13 C |
| 3,875,446 | 4/1975 | Miyaoka | 313/414 |
| 3,898,521 | 8/1975 | Saito et al. | 315/370 |
| 3,987,329 | 10/1976 | Yamazaki et al. | 313/449 |
| 4,052,643 | 10/1977 | Yamazaki et al. | 315/16 |
| 4,119,883 | 10/1978 | Miyaoka | 313/414 |
| 4,276,495 | 6/1981 | Fukushima et al. | 315/16 |
| 4,291,251 | 9/1981 | Bijma et al. | 313/413 |
| 4,334,169 | 6/1982 | Takenaka et al. | 313/414 |
| 4,337,409 | 6/1982 | Van der Heijden et al. | 313/409 |
| 4,338,541 | 7/1982 | Beck | 313/412 X |
| 4,370,592 | 1/1983 | Hughes et al. | 313/414 |
| 4,370,593 | 1/1983 | Sweigart et al. | 313/409 |
| 4,383,199 | 5/1983 | Washino et al. | 315/15 |

FOREIGN PATENT DOCUMENTS

| | | | |
|---|---|---|---|
| 0166574 | 3/1981 | Netherlands | 313/414 |

*Primary Examiner*—Arthur Kellogg
*Attorney, Agent, or Firm*—Eugene M. Whitacre; Dennis H. Irlbeck

[57] ABSTRACT

An inline electron gun, for use in a cathode-ray tube, comprises four electrode means. The first electrode means forms three inline electron beams including a center beam and two outer beams. The second electrode means pre-focuses each of the electron beams individually and converges the two outer beams toward the center beam to cross-over each other within the electron gun. The third electrode means provides a common main focus lens for the three electron beams at the crossover of the beams. And, the fourth electrode means provides a common post-focusing lens for the three electron beams which causes the two outer beams to converge with the center beam near a screen of the tube.

10 Claims, 8 Drawing Figures

CATHODE-RAY TUBE HAVING ELECTRON GUN WITH THREE FOCUS LENSES

The present invention relates to cathode-ray tubes having inline electron guns, and particularly to an inline electron gun having a pre-focus lens, a main focus lens and a post-focus lens.

BACKGROUND OF THE INVENTION

An inline electron gun is one designed to generate or initiate preferably three electron beams in a common plane, and to direct those beams along convergent paths in that plane to a point or small area of convergence near the tube screen. In one type of inline electron gun, such as that shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes.

The concept of utilizing two electrostatic focusing lenses to form an effective larger main focus lens is disclosed in U.S. Pat. No. 2,975,315, issued to C. S. Szegho on Mar. 14, 1961; in U.S. Pat. No. 3,852,637, issued to E. Yamazaki et al. on Dec. 3, 1974; and in U.S. Pat. No. 4,334,169, issued to S. Takenaka et al. on June 8, 1982. In each of these patents, four electrodes are used to form the two electrostatic focusing lenses. In each patent, one lens is formed by three of the electrodes, with the center electrode being excited with a lower voltage than the two-side electrodes which are electrically connected. The other lens in these patents is formed by two electrodes excited with different voltages.

An inline electron gun wherein a bipotential electrostatic focusing lens is expanded in size is disclosed in U.S. Pat. No. 4,370,592, issued to R. H. Hughes et al. on Jan. 25, 1983. In this patent, the enlarged lens is formed by setting back or recessing the three inline apertures in each of two focus electrodes so that the rims around the recesses which face each other provide the primary control in forming the main focus lens.

In an earlier inline electron gun, described in U.S. Pat. No. 3,448,316, issued to S. Yoshida et al. on June 3, 1969, three electron beams pass through a first lens, created by two electrodes, each having a single large aperture, which causes the two outer electron beams to cross-over at a second lens, formed by three electrodes, each having a single large aperture. The electron beams diverge after leaving the second lens and pass between convergence plates which deflect the electron beams to cause them to converge near the tube screen.

The above-described electron guns were originally developed for broadcast-type television picture tubes. However, more recent development of data display tubes has mandated further improvement in electron guns to provide a smaller, sharper electron beam spot at the tube screen. The present invention meets this need for an improved gun which can provide higher resolution images on a display screen.

SUMMARY OF THE INVENTION

An inline electron gun for use in a cathode-ray tube comprises four electrode means. The first electrode means forms three inline electron beams including a center beam and two outer beams. The second electrode means prefocuses each of the electron beams individually and converges the two outer beams toward the center beam to cross-over each other within the electron gun. The third electrode means provides a common main focus lens for the three electron beams at the crossover of the beams. And, the fourth electrode means provides a common post-focus lens for the three electron beams which causes the two outer beams to converge with the center beam near a screen of the tube.

DETAILED DESCRIPTION OF THE PREFERRED EMBODIMENTS

Figure 1:
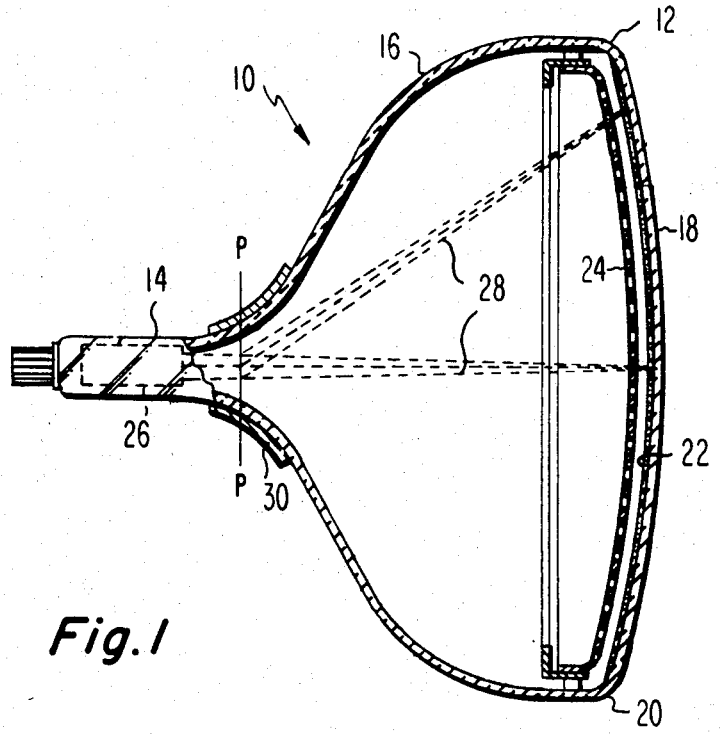
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20, which is sealed to the funnel 16. A three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color-selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the self-converging yoke 30 shown surrounding the neck 14 and funnel 12 in the neighborhood of their junction. When activated, the yoke 30 subjects the three beams 28 to vertical and horizontal magnetic flux, which cause the beams to scan horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 2:
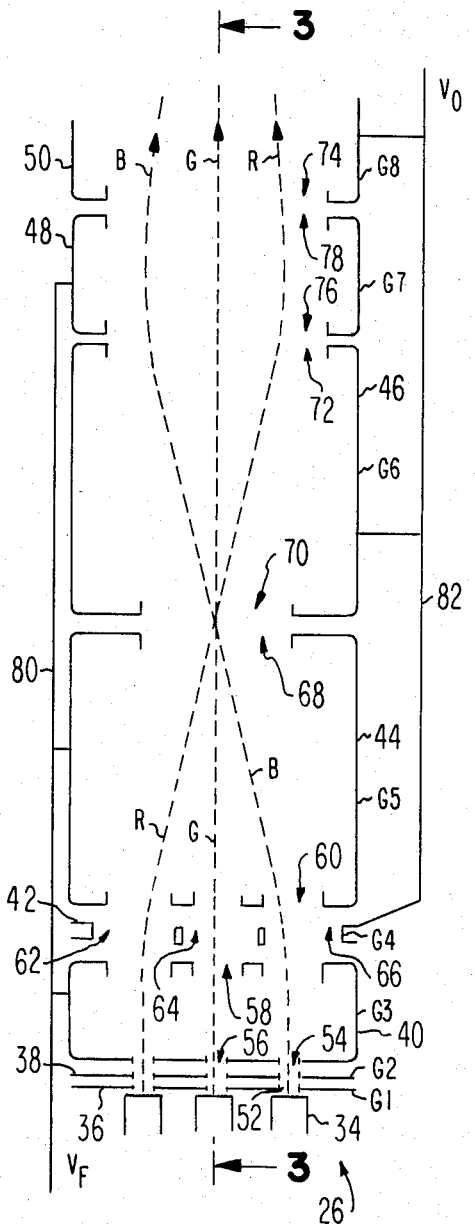
FIG. 2 is a schematic axial section view of the electron gun shown in dashed lines in FIG. 1.
Figure 3:
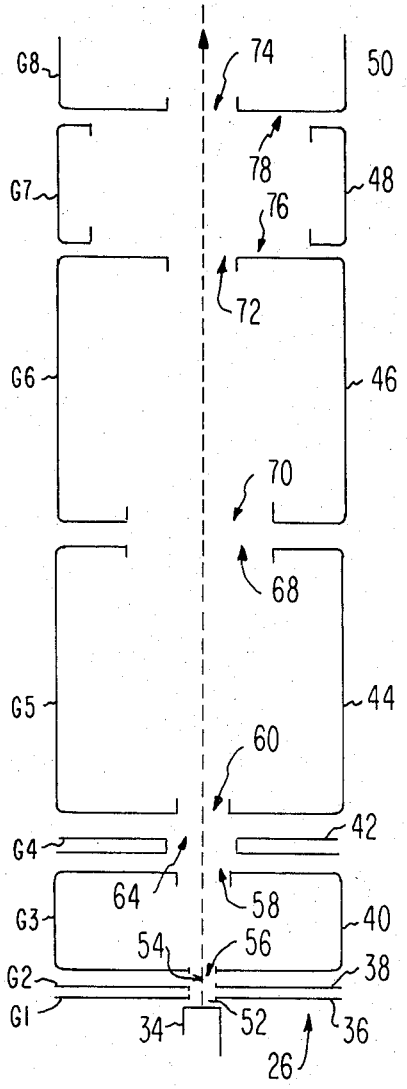
FIG. 3 is a schematic axial section view of the electron gun taken at line 3—3 of FIG. 2.

The details of the electron gun 26 are shown in FIGS. 2 and 3. The electron gun comprises two glass support rods (not shown) on which various electrodes are mounted. These electrodes include three equally spaced coplanar cathodes 34 (one for each beam), a G1 grid electrode 36, a G2 grid electrode 38, a G3 electrode 40, a G4 electrode 42, a G5 electrode 44, a G6 electrode 46, a G7 electrode 48 and a G8 electrode 50, spaced from each other in the order named.

A beam-forming region of the gun 26 comprises the three cathodes 34, the G1 grid electrode 36, the G2 grid electrode 38, and the facing side of the G3 electrode 40. In this embodiment, the G1 grid electrode 36 and the G2 grid electrode 38 are flat plates, each having three inline apertures 52 and 54, respectively, therein aligned with the surfaces of the three cathodes 34. During gun operation, fixed voltages are applied to the G1 and G2 electrodes, while the potentials applied to the cathodes 34 are individually modulated. The side of the G3 electrode 40 facing the G2 electrode 38 also is flat and includes three inline apertures 56 therein aligned with the G1 and G2 electrode apertures.

The adjacent portions of the G3 electrode 40, the G4 electrode 42 and the G5 electrode 44 form a pre-focus lens region of the gun 26. The portion of the G3 electrode 40 that faces the G4 electrode 42 includes three inline apertures 58 that are aligned with, but larger than, the apertures in the G1 and G2 electrodes. The portion of the G5 electrode 44 that faces the G4 electrode 42 also includes three apertures 60 that are the same size as, and aligned with, the apertures 58 in the G3 electrode 40. The G4 electrode 42 is a relatively thinner electrode, which includes three apertures 62, 64 and 66, that are somewhat larger than the apertures in the facing portions of the G3 and G5 electrodes. In addition, the centerlines of the outer two apertures 62 and 66 of the G4 electrode 42 are offset outwardly from the centerlines of the outer apertures in the G3 and G5 electrodes.

The adjacent portions of the G5 electrode 44 and the G6 electrode 46 form a main focus lens region of the gun 26. The portion of the G5 electrode 44 that faces the G6 electrode 46 includes a single large circular aperture 68, and the facing portion of the G6 electrode includes matching single large circular aperture 70.

The adjacent portions of the G6 electrode 46, the G7 electrode 48 and the G8 electrode 50 form a post-focus lens region of the gun 26. The portion of the G6 electrode 46 that faces the G7 electrode 48 includes a single large elongated aperture 72, with the major axis of the elogation being in the inline or coplanar direction of the electron beams. The portion of the G8 electrode 50 that faces the G7 electrode 48 also includes a single large elongated aperture 74 oriented the same as the aperture 72 in the G6 electrode. The G7 electrode 48 includes single large apertures 76 and 78 on the two sides facing the G6 and G8 electrodes, respectively.

As shown in FIG. 2, the G3, G5 and G7 electrodes are electrically connected by a lead 80 and are electrically excited with a focus voltage $V_F$. The G4, G6 and G8 electrodes are electrically connected by another lead 82 and are electrically excited with an anode voltage $V_O$.

Figure 4:
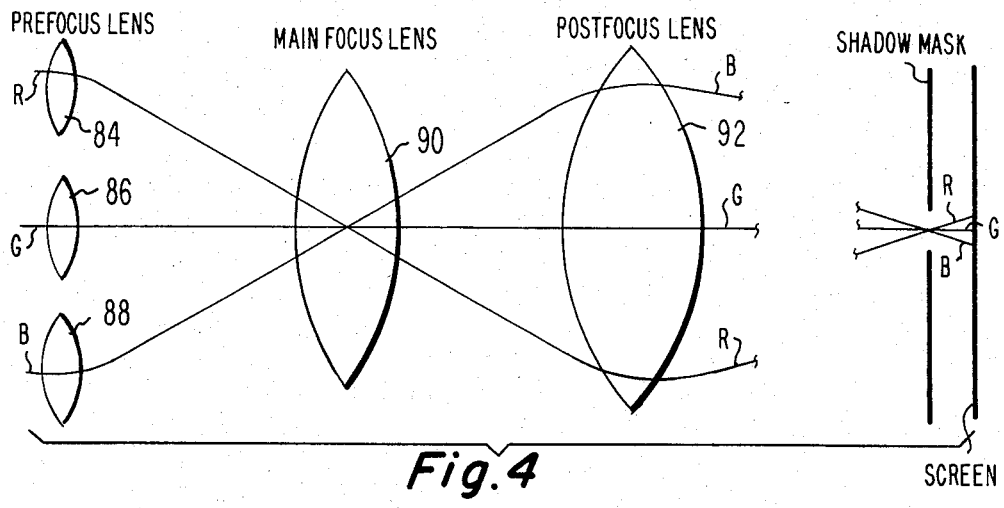
FIG. 4 illustrates the effect of the focus lenses of the electron guns of FIG. 2.

The electrostatic lenses formed by the electrodes of the electron gun 26 are shown in FIG. 4. The adjacent apertures of the G3, G4 and G5 electrodes form three lens portions 84, 86 and 88 in the pre-focus region of the gun. These lens portions focus each of the electron beams 28, (individually labelled R, G and B); and, because of the outward offset of the two outer apertures 62 and 66 in the G4 electrode, the outer two lenses 84 and 88 in the pre-focus region are asymetric with respect to the two outer electron beams R and B. This assymetry causes the two outer beams R and B to converge toward the center beam G and to cross-over each other within the gun. The facing portions of the G5 and G6 electrodes form a single large main focus lens 90 at the crossover of the electron beams. This lens 90 provides a strong electrostatic focus field for all three beams. The outer beams R and B diverge as they exit the main focus lens 90. As the diverging outer beams R and B enter the post-focus lens 92, they are converged toward each other by the asymmetric fields of the post-focus lens to cross-over at the shadow mask, so that they strike the correct phosphor elements of the screen.

Figure 5:
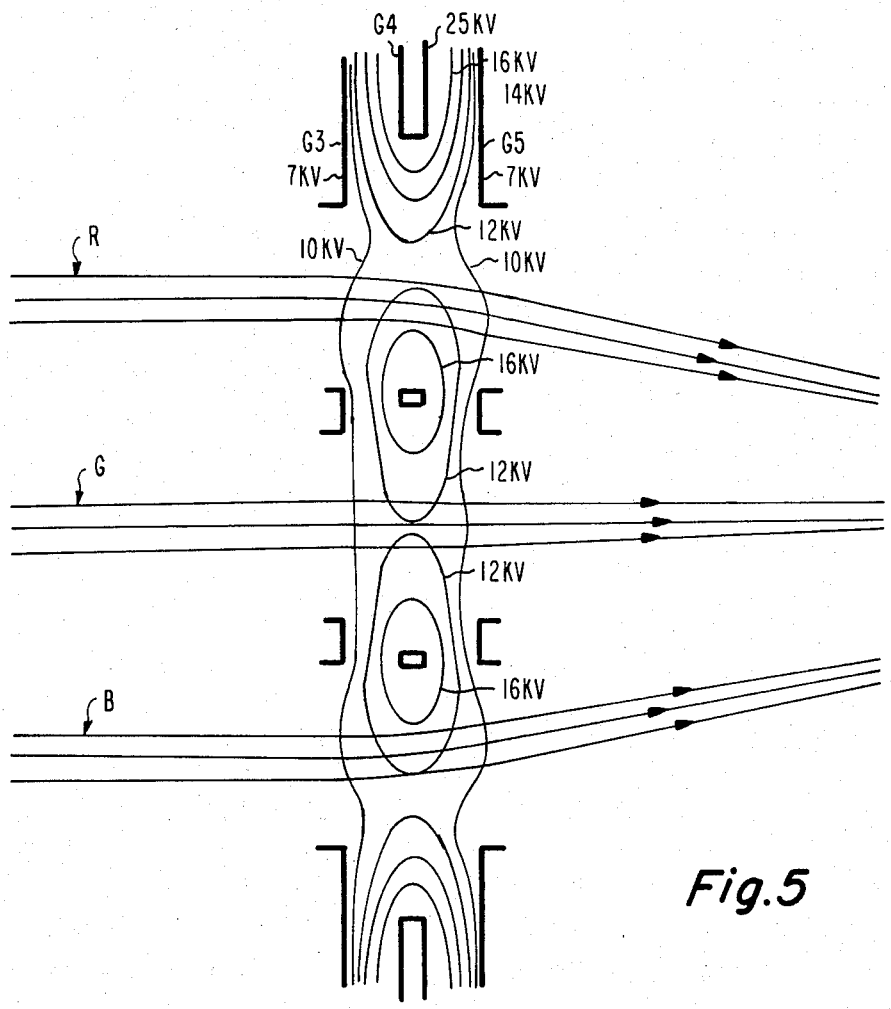
FIG. 5 illustrates the effect of the pre-focus lens of the electron gun of FIG. 2 on the electron beams.

The electrostatic field lines that comprise the pre-focus lens are shown in FIG. 5. Generally, the lower voltage lines, e.g., about 10 KV and lower, extend continuously across the electron gun. The higher voltage lines, e.g., about 12 KV and higher, are non-continuous lines, existing as islands around the center portions of the G4 electrode and as peninsulas around the outer portions of the G4 electrode. The net effect of the electrostatic lines on the center beam G is to focus the individual rays within the beam. The net effect on the outer two electron beams R and B is both to focus the rays within the beams and to converge the beams toward the center beam. The convergence is caused by the offset of the G4 apertures with respect to the G3 and G5 apertures.

Figure 6:
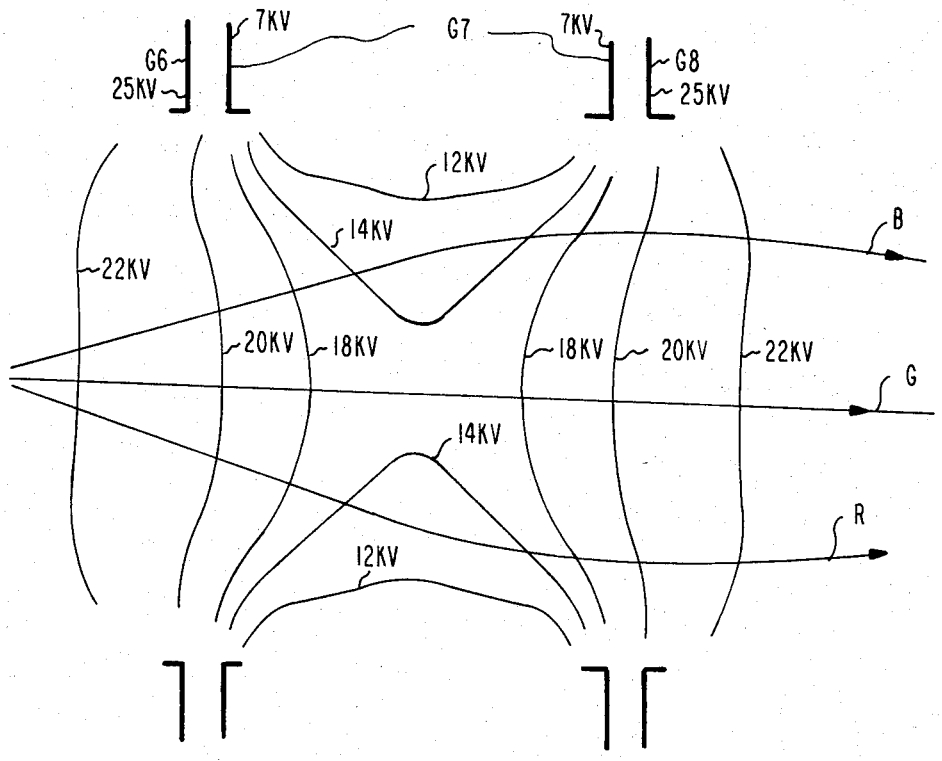
FIG. 6 illustrates the effect of the post-focus lens of the electron gun of FIG. 2 on the electron beams.

The electrostatic field lines that comprise the post-focus lens are shown in FIG. 6. Generally, the higher voltage lines, e.g., about 18 KV and higher, extend continuously across the electron gun. The lower voltage lines, e.g., about 14 KV and lower, exist as peninsulas extending toward the center of the gun. The net effect or the post-focus lens is to again focus all three beams and to converge the two outer beams R and B near the tube screen.

Some typical dimensions for the electron gun 26 of FIG. 2 are presented in Table I.

TABLE I

| | |
|---|---|
| External diameter of tube neck | 29.00 mm. |
| Internal diameter of tube neck | 24.00 mm. |
| Spacing between G1 and G2 electrodes | 0.18 mm. |
| Spacing between G2 and G3 electrodes | 1.19 mm. |
| Spacing between G3 and G4 electrodes | 1.27 mm. |
| Spacing between G4 and G5 electrodes | 1.27 mm. |
| Spacing between G5 and G6 electrodes | 1.27 mm. |
| Spacing between G6 and G7 electrodes | 1.27 mm. |
| Spacing between G7 and G8 electrodes | 1.27 mm. |
| Thickness of G1 electrode | 0.10 mm. |
| Thickness of G2 electrode | 0.25 to 0.50 mm. |
| Length of G3 electrode | 5.64 to 10.67 mm. |
| Length of G4 electrode | 0.51 to 1.78 mm. |
| Length of G5 electrode | 25.40 mm. |
| Length of G6 electrode | 25.40 mm. |
| Length of G7 electrode | 12.70 mm. |
| Aperture diameters in facing sides of G3 and G5 electrodes | 4.06 mm. |
| Aperture diameter in G4 electrode | 5.59 mm. |
| Aperture diameter in facing sides of G5 and G6 electrodes | 11.18 mm. |
| Aperture major and minor axes dimensions in facing sides of G6 and G8 electrodes | 17.27 × 5.59 mm. |
| Aperture diameter in G7 electrode | 17.27 × 11.18 mm. |
| Center-to-Center spacing in adjacent apertures in G3 electrode | 5.08 mm. |
| Center-to-Center spacing of adjacent apertures in G4 electrode | 5.84 mm. |
| Focus voltage | 7.8 to 9.5 kV. |
| Anode voltage | 25 kV. |

Figure 7:
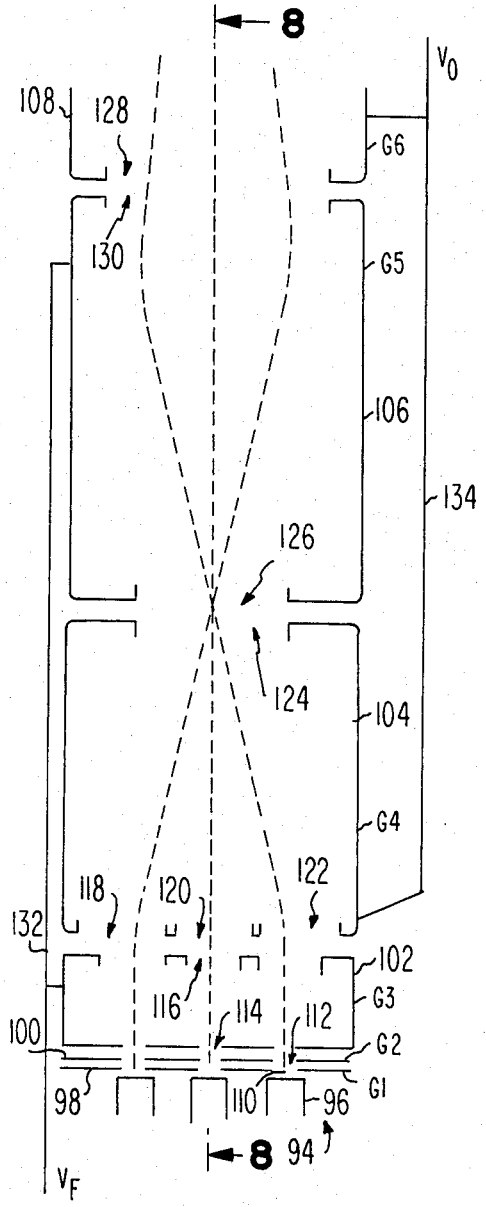
FIG. 7 is a schematic axial section view of another electron gun according to the invention.
Figure 8:
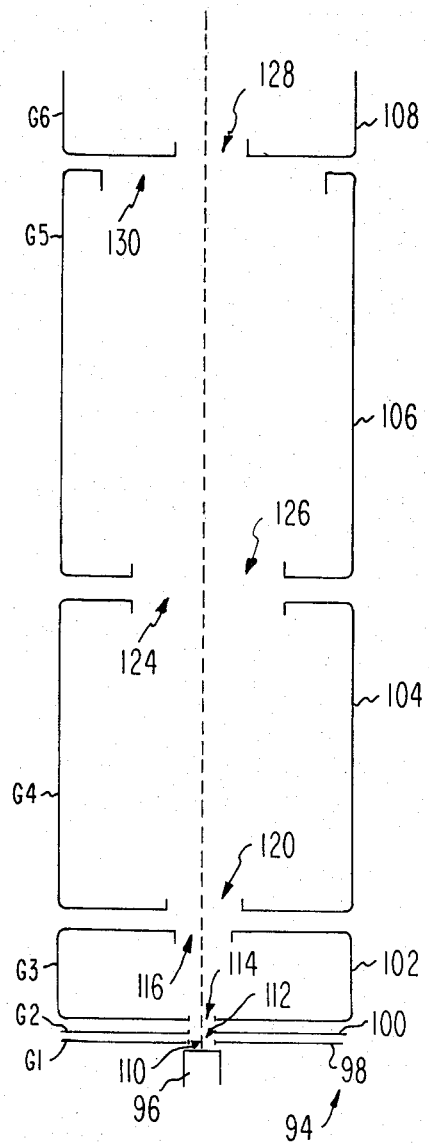
FIG. 8 is a schematic axial section view of the other electron gun taken at line 8—8 of FIG. 7.

A second electron gun 94 is shown in FIGS. 7 and 8. This electron gun also comprises two glass support rods (not shown) on which various electrodes are mounted.

These electrodes include three equally spaced coplanar cathodes 96 (one for each beam), a G1 grid electrode 98, a G2 grid electrode 100, a G3 electrode 102, a G4 electrode 104, a G5 electrode 106, and a G6 electrode 108, spaced from each other in the order named.

A beam-forming region of the gun 94 comprises the three cathodes 96, the G1 grid electrode 98, the G2 grid electrode 100, and the facing side of the G3 electrode 102. In this embodiment, the G1 grid electrode 98 and the G2 grid electrode 100 are flat plates, each having three inline apertures 110 and 112, respectively, therein aligned with the surfaces of the three cathodes 96. During gun operation, fixed voltages are applied to the G1 and G2 electrodes, while the potentials applied to the cathodes 96 are individually modulated. The side of the G3 electrode 102 facing the G2 electrode 100 also is flat and includes three inline apertures 114 therein aligned with the G1 and G2 electrode apertures.

The adjacent portions of the G3 electrode 102 and the G4 electrode 104 form a pre-focus lens region of the gun 94. The portion of the G3 electrode 102 that faces the G4 electrode 104 includes three inline apertures 116 that are aligned with, but larger than, the apertures in the G1 and G2 electrodes. The portion of the G4 electrode 104 that faces the G3 electrode 102 also includes three apertures 118, 120 and 122 that are somewhat larger than the apertures in the facing portion of the G3 electrodes. In addition, the centerlines of the outer two apertures 118 and 122 of the G4 electrode 104 are offset outwardly from the centerlines of the outer apertures in the G3 electrode.

The adjacent portions of the G4 electrode 104 and the G5 electrode 106 form a main focus lens region of the gun 94. The portion of the G4 electrode 104 that faces the G5 electrode 106 includes a single large circular aperture 124, and the facing portion of the G5 electrode includes matching single large circular aperture 126.

The adjacent portions of the G5 electrode 106 and the G6 electrode 108 form a post-focusing lens region of the gun 94. The portion of the G6 electrode 108 that faces the G5 electrode 106 includes a single large elongated aperture 128, with the major axis of the elogation being in the inline or coplanar direction of the electron beams. The G5 electrode 106 includes a single large aperture 130 on the side facing the G6 electrode.

As shown in FIG. 7, the G3 and G5 electrodes are electrically connected by a lead 132 and are electrically excited with a focus voltage $V_F$. The G4 and G6 electrodes are electrically connected by another lead 134 and are electrically excited with an anode voltage $V_O$.

Some typical dimensions for the electron gun 94 of FIG. 2 are presented in Table II.

TABLE II

| | |
|---|---|
| External diameter of tube neck | 29.00 mm. |
| Internal diameter of tube neck | 24.00 mm. |
| Spacing between G1 and G2 electrodes | 0.18 mm. |
| Spacing between G2 and G3 electrodes | 1.19 mm. |
| Spacing between G3 and G4 electrodes | 1.27 mm. |
| Spacing between G4 and G5 electrodes | 1.27 mm. |
| Spacing between G5 and G6 electrodes | 1.27 mm. |
| Thickness of G1 electrode | 0.10 mm. |
| Thickness of G2 electrode | 0.25 to 0.50 mm. |
| Length of G3 electrode | 5.64 to 10.67 mm. |
| Length of G4 electrode | 27.43 mm. |
| Length of G5 electrode | 25.40 mm. |
| Aperture diameters in prefocus side of G3 electrode | 4.06 mm. |
| Aperture diameters in prefocus side of G4 electrode | 5.59 mm. |

TABLE II-continued

| | |
|---|---|
| Aperture diameters in facing sides of G4 and G5 electrodes | 11.18 mm. |
| Aperture diameter in postfocus side of G5 electrode | 17.27 × 11.18 mm. |
| Aperture major and minor axis dimension in G6 electrode | 17.27 × 5.59 mm. |
| Center-to-Center spacing of adjacent apertures in prefocus side of G3 electrode | 5.08 mm. |
| Center-to-Center spacing of adjacent apertures in prefocus side of G4 electrode | 5.84 mm. |
| Focus voltage | 7.8 to 9.5 kV. |
| Anode voltage | 25 kV. |

The above-described electron gun embodiments offer substantial improvement in the size of the electron beam at the tube screen. As previously noted, data display tubes require a substantially smaller and sharper electron beam spot at the screen than is required in a broadcast-type television picture tube.

In general, the electron beam spot diameter, $D_s$, on the screen is related to the diameter, Db, of the beam in the main lens by the formula:

$$D_s = C/D_b = C_a D_b^3,$$

where the quality factor, C, and the aberration coefficient, $C_a$, are constants of the lens. For an anode or ultor voltage of 25 kV and a beam current of 3.5 mA, the quality factor constant C is about 4.5 $mm^2$ for one of the better (prior) electron guns currently being used in broadcast-type television picture tubes having about a 67-cm diagonal screen dimension. Significant reductions of C below this value are not thought possible because of space-charge expansion of the beam between the electron gun and the screen. In the same better (prior) electron guns, the aberration coefficient $C_a$ is about 0.10 $mm^{-2}$. Substituting these coefficients and a typical value of 2 mm for $D_b$ in the formula above yields an electron beam spot size of 3.05 mm at the screen.

It would first appear that a smaller electron beam spot can be attained at the screen if $D_b$ is enlarged. However, substitution of an enlarged $D_b$ of 3 mm into the formula with the given constants, yields an increase in spot size to 4.20 mm.

In the electron gun embodiments of the present invention, an enlarged $D_b$ (e.g., 3 mm) is attained while, through design of the guns, the aberration coefficient is greatly reduced. For example, the electron gun described with respect to Table I has an aberration coefficient $C_a$ of 0.005 $mm^{-2}$, and the electron gun described with respect to Table II has an aberration coefficient $C_a$ of 0.006 $mm^{-2}$. When these aberration coefficients are substituted in the formula above and an enlarged $D_b$ of 3 mm, the spot sizes obtained at the screen are 1.635 mm and 1.662 mm, respectively.

What is claimed is:

1. An inline electron gun for use in a cathode-ray tube, comprising first electrode means for forming three inline electron beams including a center beam and two outer beams, second electrode means for prefocusing each of said electron beams individually and for converging said two outer beams toward said center beam to cross-over each other within said electron gun, third electrode means for providing a common main focus lens for said three electron beams at the crossover of said beams, and fourth electrode means for providing a common post-focus lens for said three electron beams which causes said two outer beams to converge with said center beam near a screen of said tube.

2. The electron gun as defined in claim 1, wherein said second electrode means comprises three electrodes, namely a center electrode and two side electrodes, spaced from said first electrode means, the two side electrodes being electrically connected.

3. The electron gun as defined in claim 2, wherein each of said three electrodes includes three inline apertures therein for passage of said three electron beams, the two outer apertures in said center electrode being offset outwardly from the two outer apertures in each of the two outer electrodes.

4. The electron gun as defined in claim 1, wherein said third electrode means comprises two electrodes.

5. The electron gun as defined in claim 1, wherein said fourth electrode means comprises three electrodes, namely a center electrode and two side electrodes, the two side electrodes being electrically connected.

6. The electron gun as defined in claim 1, wherein said second electrode means comprises two electrodes, each of said two electrodes having three inline apertures therein for passage of said three electron beams, the outer two apertures of the electrode of said second electrode means that is farthest from said first electrode means being offset outwardly from the outer two apertures of the closest electrode to said first electrode means.

7. The electron gun as defined in claim 1, wherein said fourth electrode means comprises two electrodes.

8. An inline electron gun for use in a cathode-ray tube, comprising a beam-forming region including three inline cathodes and at least two grids spaced from said cathodes for forming three inline electron beams, namely a center beam and two side beams, at least two electrodes forming a pre-focus lens, which is capable of causing said side beams to cross-over within said gun, at least two electrodes forming a main focus lens at the crossover of said beams, and at least two electrodes forming a post-focus lens, which is capable of causing the side beams to converge with the center beam beyond said electron gun.

9. The electron gun as defined in claim 8, wherein said pre-focus lens is formed by three electrodes each having three inline apertures therein, said main focus lens is formed by two electrodes each having a single aperture therein, and said post-focus lens is formed by three electrodes each having a single aperture therein.

10. The electron gun as defined in claim 8, wherein said pre-focus lens is formed by two electrodes each having three apertures therein, said main focus lens is formed by two electrodes each having a single aperture therein, and said post-focus lens is formed by two electrodes each having a single aperture therein.

* * * * *